United States Patent [19]

Toffolon

[11] 4,453,773

[45] Jun. 12, 1984

[54] PAVEMENT BREAKING APPARATUS

[76] Inventor: Roger L. Toffolon, 953 MacArthur Blvd. SE., Stuart, Fla. 33494

[21] Appl. No.: 454,738

[22] Filed: Dec. 30, 1982

[51] Int. Cl.[3] ..... E01C 23/09

[52] U.S. Cl. ..... 299/37; 173/52; 173/112; 173/15; 173/43; 125/7

[58] Field of Search ..... 299/37; 173/15, 52, 173/43, 44, 112, 147; 404/90; 125/6, 7

[56] References Cited

U.S. PATENT DOCUMENTS

| | | | |
|---|---|---|---|
| 1,697,648 | 1/1929 | Hansen | 173/52 |
| 3,241,622 | 3/1966 | Ottosson et al. | 173/15 X |
| 3,464,500 | 9/1969 | Wallace | 173/15 |
| 3,904,245 | 9/1975 | Clarke | 299/37 |
| 4,105,081 | 8/1978 | Perraud | 173/147 X |
| 4,230,369 | 10/1980 | Gurries | 299/37 X |
| 4,300,282 | 11/1981 | Bunyea et al. | 173/15 X |

*Primary Examiner*—Ernest R. Purser
*Assistant Examiner*—Beverly E. Hjorth
*Attorney, Agent, or Firm*—McCormick, Paulding & Huber

[57] ABSTRACT

Apparatus for breaking concrete and asphalt pavement and the like comprising a frame adapted to be supported by and above pavement to be broken. Power operated means move the frame in one and opposite directions relative to and in parallel relationship with the pavement. A plurality of air hammers are supported in a gang parallel arrangement by the frame with their cutting tools aligned in a closely spaced parallel series. Cutting ends of the tools are adjacent the pavement with the series of tools extending in one direction and frame movement occurs in a direction substantially at right angles relative thereto. Thus, the frame movement defines a predetermined generally rectangular path of movement and pavement breaking operation of the cutting tools. A cradle on the frame is moveable relative to the frame for adjusting both the height and the angle of attack of the cutting tools relative to the pavement. The angle of attack is adjustable so as to be displaced substantially from the plane of the pavement and from a plane perpendicular thereto, the tools thus being adapted to hardness and other pavement characteristics. In one form the frame is mounted on a fixed frame and is moveable therealong by a power operated means. In a second form the frame is mounted on a self-propelled vehicle for movement with the vehicle parallel to the pavement.

9 Claims, 4 Drawing Figures

PAVEMENT BREAKING APPARATUS

BACKGROUND OF THE INVENTION

Various means are employed in the repair and replacement of concrete and asphalt pavement. Hard tip saws are satisfactory in certain cases but the most widely used tool is a power operated impact device such as the conventional air hammer. Such hammers are normally held and actuated individually by an operator who moves the hammer horizontally as required in the pavement breaking operation. The operation is effective with a skilled operator but is in all cases a slow and tedious procedure.

The prior art also shows apparatus employing a plurality of impact devices such as air hammers but such apparatus is not believed to be commercially available. The reason for this may be the inefficiency of a plurality of air hammers acting vertically in a gang arrangement. The hammers tend to cut individual holes and jamming, tool breakage and other difficulties are encountered in advancing a gang of vertical hammers so as to provide a swath of broken pavement as may be required in the removal and replacement of concrete on bridge decks.

It is the general object of the present invention to provide an improved apparatus employing a plurality of power operated impact devices in a gang arrangement wherein the devices may be moved progressively to efficiently provide a wide swath of broken pavement with the depth of cut closely controlled.

SUMMARY OF THE INVENTION

In fulfillment of the foregoing object and in accordance with the present invention, a frame is provided and is adapted to be supported by and above concrete or asphalt pavement to be broken. A power operated means operatively associated with the frame moves the latter in one and an opposite direction relative to the pavement and in parallel relationship thereto. A plurality of power operated impact devices are provided each with a reciprocable cutting tool which has operating and return strokes occuring in rapid succession. The operating strokes are of course adapted to engage and break pavement or the like. The impact devices are supported in a gang parallel arrangement by the frame with their cutting tools aligned in a closely spaced parallel series and with the cutting ends of the tools substantially aligned when the series of tools is viewed from end-to-end. With the cutting ends of the tools adjacent the pavement, the series of tools and their cutting ends extend in parallel relationship with the pavement in one direction. The aforesaid frame movement in one and an opposite direction is generally perpendicular to the direction of alignment of the cutting tools so that frame movement serves to define a predetermined generally rectangular path of movement and pavement breaking operation of the cutting tools.

Support means mounted on the frame and which is moveable relative thereto carries the plurality of impact devices and provides for adjustment of the angle of attack of the cutting tools relative to the pavement therebeneath. More particularly, the impact devices and their cutting tools are mounted for angular adjustment so that the lines of reciprocation of the tools can be preselected to provide angles of attack which are displaced substantially from both the surface of the pavement and from the vertical, or from a plane perpendicular to the pavement. Thus, the angle of attack is adjusted as required for hardness and other characteristics of the pavement and, more importantly, for the efficient progressive movement of the impact devices along the pavement. That is, the plurality of impact devices, with their angle of attack properly adjusted, can be advanced continuously along the pavement to efficiently break the pavement to a desired depth, the impact devices serving to terminate operation individually on the attainment of the desired depth of cut and termination of forward movement. Momentary hesitation in the continuous advance of impact devices may be necessary as for an attack angle adjustment occasioned by a hard spot in the pavement but jamming, stop and go, or leapfrog operation as may be encountered with vertical impact devices is wholly avoided. During such momentary operation, only those impact devices which encounter resistance continue to function, the remaining devices which have reached the desired depth and thus encounter no further resistance, cease to operate. If the advance movement is properly coordinated with the cutting capability of the impact devices, then no hesitation or stopping whatever may be necessary.

DESCRIPTION OF PREFERRED EMBODIMENTS

Figure 1:
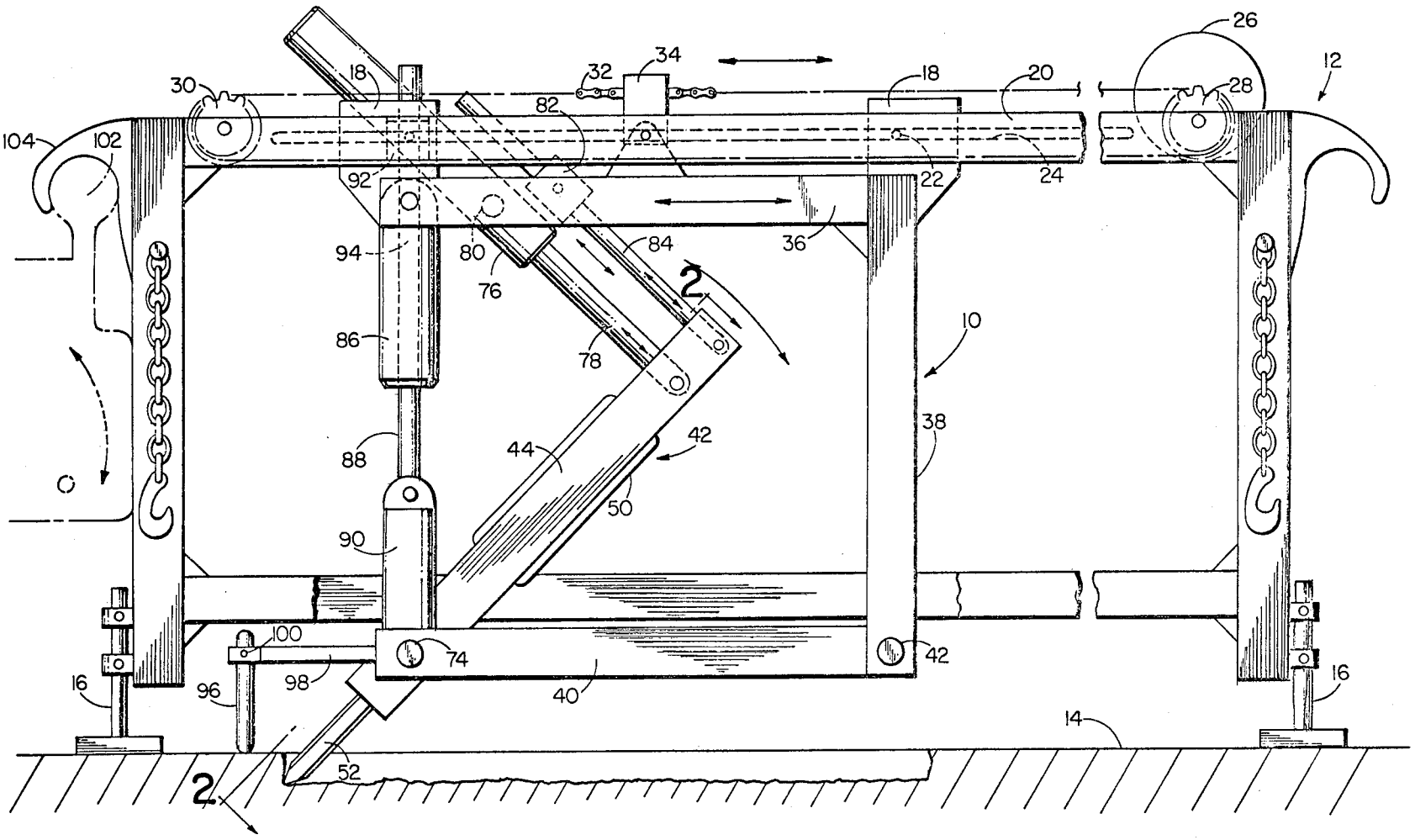
FIG. 1 is a schematic illustration of a pavement breaking apparatus constructed in accordance with the present invention.

Referring particularly to FIG. 1, it will be observed that a moveable frame indicated generally at 10 is mounted on and supported by a fixed frame indicated generally at 12. The frame 10 is moveable along and relative to the frame 12 in one and an opposite direction parallel to a section of pavement 14 therebeneath which supports the fixed frame 12 on adjustable legs 16, 16. Four (4) support or slide brackets 18, 18, two shown, carry the moveable frame 10 and are mounted for sliding movement in one and an opposite direction along horizontal frame members 20, 20, one shown. A pin slot arrangement 22, 24 may also be provided for precise guidance and a power operated means is preferably provided for moving the frame 10 relative to the fixed frame 12.

The presently preferred power operated means for moving the frame 10 comprises a motor 26 which may be of the pneumatic type and which drives a sprocket 28. The sprocket 28 has a cooperating sprocket 30 at an opposite or front end portion of the frame 12 and a chain 32 extends between and about the sprockets 28, 30. A bracket 34 includes a means not shown for fixedly connecting the sprocket chain 32 thereto and is mounted on and fixed to an upper horizontal member 36 of the moveable frame 10. As will be apparent, the motor 26 can thus be operated to rotate the sprocket 28 and thereby to drive the chain 32 and, more particularly, to drive the upper run of the chain 32 in the left-hand direction in FIG. 1 to move the frame 10 leftwardly or in one direction relative to the fixed frame 12. With a reversible motor 26, the sprocket 28 may be rotated in an opposite direction whereby to move the frame 10 rightwardly or in an opposite direction relative to the pavement 14 therebeneath. Manual controls associated with the motor 26 may of course be operated to stop and start frame movement as required.

As shown, and as presently preferred, the moveable frame 10 comprises one or more upper horizontal frame members 36, one shown, and one or more fixed rear depending members 38, one shown, which pivotally support a lower frame member or members 40 at a pivot pin 42. The frame members 38, 40, including counterpart frame members not shown, in turn pivotally support at a front end of the member 40, a support means or cradle indicated generally at 42. The support means or cradle 42, FIG. 2, may comprise front and rear frame members 44, 46 and a cross frame member 48 for carrying a plurality of power operated impact devices 50, 50. The power operated devices 50, 50 are arranged in parallel with their cutting tools 52, 52 extending between upper and lower plates 54, 56 which comprise a front cross frame member which cooperates with the cross frame member 48. Appropriate recesses 58, 58 in one or both of the plates 54, 56 receive and guide cutting tools 52, 52 associated with the impact devices 50, 50. The impact devices 50, 50 also have individual biasing springs such as a spring 60 associated therewith. As illustrated, the spring 60 is disposed rightwardly or rearwardly of the impact device 50 illustrated in FIG. 2 and engages a top portion 62 of the device whereby to urge the housing of the device 50 leftwardly or forwardly in FIG. 2. At its lefthand or front end portion 64, the housing of the impact device 50 engages the plates 54, 56 but is slidable rearwardly or rightwardly relative thereto between side plates 66, 68.

Figure 2:
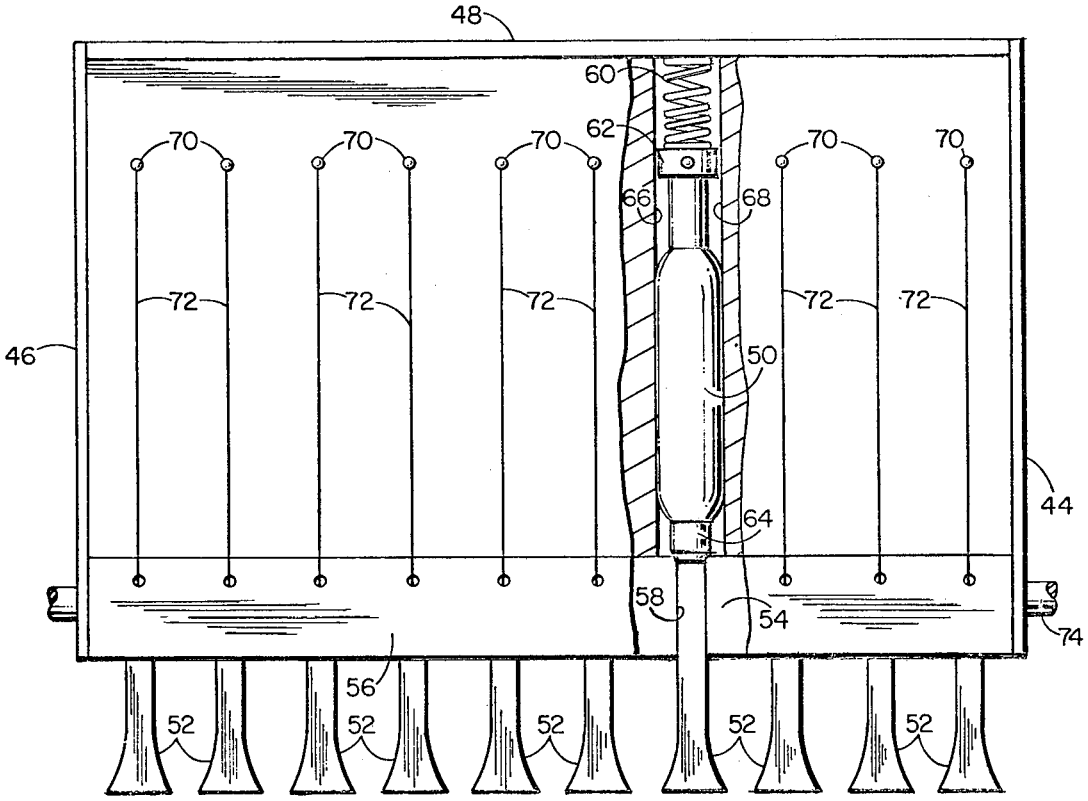
FIG. 2 is a somewhat schematic sectional view taken generally as indicated at 2, 2 in FIG. 1.

Preferably the power operated impact devices 50, 50 comprise air hammers of a conventional type having a trigger or actuating device which will cause the hammer to operate when its associated cutting tool engages pavement and urges the hammer rightwardly in FIG. 2. That is, the actuating device or trigger operates on contact and slight retraction of the hammer against its biasing spring 60. If for example, the cutting tool engages pavement and the hammer is retracted one inch, the hammer will operate until the tool has cut through one inch of pavement returning to its original position. Thus, when a desired depth of cut has been obtained, operation of the air hammers and their cutting tools will be terminated. Further, it is to be noted that termination of operation of the hammers occurs individually and independently so that a single hammer, for example cutting through relatively soft material and reaching its desired depth of cut prior to the other hammers, will terminate its operation while the remaining hammers continue to operate. Thus, the depth of cut controls the operation of the hammers independently and a uniform depth of cut is thus achieved. With the air hammers advancing angularly at a controlled and coordinated rate, however, as mentioned above, continuous operation can be achieved with all hammers in substantially continous operation as their cutting tools progressively engage and break pavement to a closely controlled depth.

Figure 3:
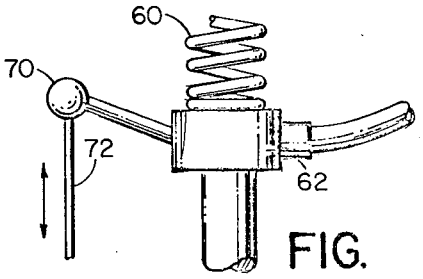
FIG. 3 is an enlarged fragmentary view showing an actuating device on a single power operated impact device.

Referring to FIG. 3, it will be observed that an actuating device or trigger 70 associated with the hammer 50 shown has a flexible trip cord 72 attached thereto for lefthand or counterclockwise pivotal movement of the trigger. Cords 72, 72 as illustrated in FIG. 2 have their opposite ends attached to the plate 56 at a lefthand or forward end portion of the cradle 42. Thus, when the cutting tools 52, 52 engage pavement and the hammers 50, 50 are urged rightwardly or rearwardly in FIG. 2, the initial sliding movement of the hammers will result in actuation of the several triggers 70, 70 and in the desired individually controlled operation of the hammers. The springs 60, 60 accomodate the necessary slight rightward or rearward movement of the air hammers 50, 50, serve to absorb shock during operation of the hammers, and assure precise leftward or forward positioning of the hammers against the plates 54, 56 when operation is terminated.

Each of the several hammers 50, 50 is similarly controlled in its operation, as described, and the hammers are arranged in a parallel series as illustrated with ten (10) hammers provided in the apparatus shown. The number of air hammers may of course vary with the desired width of the section to be cut. The cutting tools 52, 52 associated with the hammers may also vary widely but it is the presently preferred practice to provide tools with a horizontally wide chisel configuration as illustrated in FIG. 2. With such an arrangement, the spacing between tools may be about one half to three quarters of an inch and approximately a three foot wide swath or section may be broken in operation of the apparatus.

An important feature of the present invention resides in the angular adjustability of the cradle 42 for adjustment of the angle of attack of the tools 52, 52 relative to the pavement 14. As mentioned above, the frame members 40, 40 are pivotally supported at rear end portions at 42 and, in turn, the cradle 42 is pivotally supported at front end portions of the members 40 at 74. Thus, the cradle 42 may be swung arcuately at an upper or rear end portion in FIG. 1 and in clockwise and counterclockwise directions whereby to adjust the angle of attack of tools 52, 52 as desired. Further, the frame members 40, 40 may be swung upwardly and downwardly at front end portions for vertical adjustment of the tools 52, 52.

As presently preferred and as illustrated, one or more fluid cylinder means is provided as at 76 for swinging the cradle 42 to adjusted positions for varying the angle of attack of the tools 52, 52. An air cylinder shown at 76 has its rod 78 connected to the cradle 42 and is provided with a pivotal mount at 80 on the frame member 36. The cylinder 76 provides for movement of the cradle 42 through a desired large angle which may vary between ten degrees and eighty degrees measured from the surface of the pavement 14. Preferably, the angle of adjustment extends at least between twenty and seventy degrees from the surface of the pavement and, a presently preferred operating or running angle after starting is approximately thirty degrees, or, sixty degrees measured from a vertical plane. That is, efficient pavement breaking or cutting operation is achieved with the tools 52, 52 advancing continuosly at approximately sixty degrees from the vertical and the frame 10 moving from right to left in FIG. 1 at a rate of approximately six feet per minute. For start up operation, it is found that an angle of approximately fifty degrees from the pavement, or, forty degrees measured from the vertical is desirable and it may also be desirable to adjust the angle of attack from sixty degrees to forty degrees when hard spots are encountered in the continuous operation of the apparatus. As stated, such adjustments can be accomplished if necessary with a momentary stop in the right to left movement of the frame 10 and in certain cases running adjustments are also possible.

When an air cylinder is used as at 76 it is also desirable to include a brake such as the brake shown at 82 for positively establishing the position of the cradle 42. A rod 84 connects with the cradle 42 and the brake 82 is mounted on the frame member 36. With hydraulic cylinders used for adjusting the cradle 42 the associated brake would be unnecessary.

Vertical adjustment of the tools 52, 52 may be accomplished through one or more fluid cylinders such as an air cylinder 86 connected with the frame member 36 and having its depending rod 88 connected with a bracket 90. The bracket 90 is mounted on and across a front end portion of the frame members 40, 40 whereby to swing the members upwardly and downwardly at their front end portions as required to adjust the position of the tools 52, 52 and thereby to establish cooperatively with the cradle 42 the desired depth of cut in the pavement 14. When an air cylinder is used at 86, a brake 92 may also be provided with a rod 94 extending therefrom to the bracket 90. Still further, a gauge means may also be provided as at 96 for establishing or reestablishing a depth of cut. A support member 98 on the members 40, 40 slidably mounts the gauge member 96 and a binder screw 100 fixes the member 96 in adjusted positions relative to the member 98.

In operation of the FIG. 1 apparatus, the moveable frame 10 is moved from right to left to cut a path or swath in concrete or asphalt pavement such as 14 therebeneath. The depth of cut may, for example, be an inch or two and if necessary a second pass can be readily accomplished by returning the frame rightwardly and thereafter again moving the frame leftwardly as required. An accurate cutting depth is provided for with the individual control of the several air hammers as mentioned above. That is, an accurate depth of cut is provided as for example at 1 inch, 1½ inches or 2 inches with the hammers individually ceasing operation if necessary when the pavement area therebeneath has been broken or cut to the desired depth.

A second and succeeding sections of pavement may be thereafter broken by moving the fixed frame 12 with a power operated vehicle having a lifting bar 102 engagable beneath a lifting attachment 104 which may be at the end of the frame as shown, or at other locations.

Figure 4:
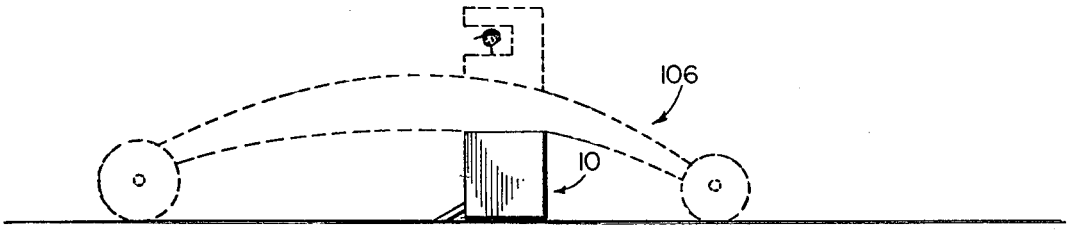
FIG. 4 is a schematic illustration of a second form of the invention with the pavement breaking apparatus mounted on a self-powered vehicle.

In FIG. 4 a self-propelled vehicle is provided in the form of a road grader 106 and a frame such as the moveable frame 10 is mounted therebeneath for pavement breaking operation. As will be apparent, the grader may be moved leftwardly to cut a swath of pavement of indeterminate length and width dependent upon the number of air hammers carried by the frame. On a return movement of the grader in an opposite direction, a second parallel swath may be cut adjacent the first swath as may be required. The frame 10 may of course include a cradle and air hammer apparatus substantially identical with that described above.

I claim:

1. Apparatus for breaking concrete and asphalt pavement and the like and comprising a frame adapted to be supported by and above pavement to be broken, power operated means operatively associated with said frame for moving the latter in one and an opposite direction relative to the pavement and in parallel relationship thereto, a plurality of power operated impact devices each including a reciprocable cutting tool having operating and return strokes occurring in rapid succession, the former strokes for engaging and breaking pavement and the like, said devices being supported in a gang parallel arrangement by said frame with their cutting tools aligned in a closely spaced parallel series and with their cutting ends substantially aligned when the series of tools is viewed from end-to-end, and said devices being arranged so that the cutting ends of their tools are adjacent the pavement with the series of tools and their cutting ends in parallel relationship with the pavement and extending substantially at right angles relative to the direction of frame movement, said frame movement in one and an opposite direction thus serving to move the tools parallel to the pavement substantially at right angles relative to said one and opposite directions, and said frame movement thus serving to define a predetermined generally rectangular path of movement and pavement breaking operation of the cutting tools relative to the pavement, impact device support means on said frame movable relative to the frame for adjusting the angle of attack of the cutting tools relative to pavement therebeneath, said means supporting the impact devices and their cutting tools for angular adjustment so that the lines of reciprocation of the tools can be preselected to provide angles of attack which are displaced substantially from both the surface of the pavement and from a plane perpendicular thereto and which are particularly well suited to the hardness and other characteristics of the pavement, and said impact devices being mounted on said support means for movement relative thereto and relative to each other along their lines of reciprocation, a resilient biasing means operatively associated with each of said impact devices at an end thereof opposite its cutting tool and independently urging the same bodily along its line of reciprocation toward its said tool, stop means operatively associated with each impact device and limiting such movement of the device along its line of reciprocation toward its cutting tool, a separate trigger means operatively associated with each impact device, and a trigger actuating means for each trigger operable to actuate an associated impact device on rearward movement of the impact device against the urging of its resilient biasing means and away from its stop means, operation of each impact device thus being individually controlled and individually terminated when a desired depth of pavement cut has been achieved.

2. Apparatus for breaking concrete and asphalt pavement and the like as set forth in claim 1 wherein said means supporting said impact devices provides for adjustment of the angle of attack of the cutting tools through a range of angles varying between ten degrees and eighty degrees from the surface of the pavement.

3. Apparatus for breaking concrete and asphalt pavement and the like as set forth in claim 2 wherein said means supporting said impact devices provides for adjustment of the angle of attack of the cutting tools through a range between twenty degrees and seventy degrees from the surface of the pavement.

4. Apparatus for breaking concrete and asphalt pavement and the like as set forth in claim 1 wherein said means supporting said impact devices takes the form of a pivotally mounted cradle for mounting the devices, and wherein first and second power operated means are provided respectively for adjustment of the cradle toward and away from the pavement and angularly with respect to the pavement.

5. Apparatus for breaking concrete and asphalt pavement and the like as set forth in claim 4 wherein said impact devices and said first and second power operated means are air operated and respectively take the form of conventional air hammers and conventional air cylinders.

6. Apparatus for breaking concrete and asphalt pavement and the like as set forth in claim 5 wherein first and second brake means are provided respectively for securing the cradle in adjusted positions as to height above the pavement and angle of attack relative thereto.

7. Apparatus for breaking concrete and asphalt pavement and the like as set forth in claim 4 and including adjustable gage means for establishing the height adjustment of the cradle and impact devices relative to the pavement.

8. Apparatus for breaking concrete and asphalt pavement and the like as set forth in claim 4 and including a fixed frame supporting said movable frame and adapted to be supported by the pavement therebeneath, said power operated means being connected between said fixed and movable frames and serving to move the latter in said one and opposite directions relative to the former.

9. Apparatus for breaking concrete and asphalt pavement and the like as set forth in claim 4 wherein said power operated means comprises a self-powered vehicle supporting said frame for movement therewith in one and opposite directions relative to and in parallel relationship with pavement therebeneath.

* * * * *